US005300991A

United States Patent [19]

Hiraike

[11] Patent Number: 5,300,991

[45] Date of Patent: Apr. 5, 1994

[54] IMAGE FORMING APPARATUS WITH TONER REPLENISHER

[75] Inventor: Fumiaki Hiraike, Hachioji, Japan

[73] Assignee: Konica Corporation, Japan

[21] Appl. No.: 29,887

[22] Filed: Mar. 11, 1993

[30] Foreign Application Priority Data

Apr. 14, 1992 [JP] Japan ..... 4-95536

[51] Int. Cl.[5] ..... G03G 15/06

[52] U.S. Cl. ..... 355/260; 220/262; 220/345; 222/469; 222/559; 355/200; 355/245

[58] Field of Search ..... 355/260, 245, 200, 210, 355/211; 220/262, 345-346; 222/DIG. 1, 469, 470, 561, 559

[56] References Cited

U.S. PATENT DOCUMENTS

| | | | |
|---|---|---|---|
| 3,756,136 | 9/1973 | Samczyk et al. | 220/262 X |
| 4,327,845 | 5/1982 | Keyes et al. | 222/469 X |
| 4,435,065 | 3/1984 | Wada | 355/245 |
| 4,475,672 | 10/1984 | Whitehead | 222/561 X |
| 4,809,867 | 3/1989 | Choi | 220/346 X |
| 4,841,333 | 6/1989 | Damji | 355/260 X |
| 4,857,954 | 8/1989 | Abuyama et al. | 355/245 |
| 5,150,162 | 9/1992 | Saito | 355/260 |

FOREIGN PATENT DOCUMENTS

| | | | |
|---|---|---|---|
| 0195465 | 8/1989 | Japan | 355/260 |
| 1316925 | 6/1987 | U.S.S.R. | 222/561 |
| 1521677 | 11/1989 | U.S.S.R. | 222/561 |

*Primary Examiner*—Matthew S. Smith
*Attorney, Agent, or Firm*—Jordan B. Bierman

[57] ABSTRACT

An image forming machine having an image carrier on which an electrostatic latent image is formed, a developing device that develops the latent image and a toner replenisher that replenish toner to the developing device. The toner replenisher has a cover attached to the upper opening portion thereof which can be opened or closed when a pivotable member having a rack, provided to the toner replenisher, is moved. A pinion is rotated by the rack, and the pinion rotates a shaft to move rotatable members, which in turn open or close the cover.

3 Claims, 3 Drawing Sheets

IMAGE FORMING APPARATUS WITH TONER REPLENISHER

BACKGROUND OF THE INVENTION

The present invention relates to a developer supply device to supply developer composed of powder to a developing unit provided in an image forming apparatus.

In an image forming apparatus such as a copier and printer by which an electrostatic latent image formed on a photoreceptor drum is developed by a developing device with dry and powdered developer (referred to as toner, hereinafter) so as to form a visual image, the toner provided in the developing unit is consumed each time the visual image is formed on the photoreceptor drum surface. As color copiers and printers have been developed recently, the dimensions of the apparatus have been reduced. Consequently, the developing devices of copiers and printers have been made compact. In accordance with the progress of the apparatus, the operation speed is increased and toner consumption is also increased. Therefore, it is necessary to supply toner to the developing device during image formation. In order to supply a large amount of toner as described above, a relatively large-sized toner supply device is provided separately from the developing device. In general, the toner supply device is attached above the developing device, and toner is supplied to the toner supply device before the toner in the device has been completely consumed. In this case, toner is supplied to the device from the outside when a cover of the toner supply device is slid along a groove. When new toner is supplied to the toner supply device, it is necessary to open the cover completely with respect to an opening through which toner is supplied. In order to open the cover, a large operating lever is generally provided because a long stroke is required to open the cover.

The present invention has been achieved to solve the aforementioned problems.

In order to completely open the opening of the toner supply device, a long stroke is required for the operating means. As a result, the dimensions of the device are increased, which is a problem.

In order to prevent the toner from scattering, the cover is tightly contacted with a sliding portion of the toner supply device. Therefore, strong force is required to slide the cover, so that it is very hard for an operator to slide the cover when toner is supplied.

In order to record color images, toner supply devices for 4 colors including yellow, magenta, cyan and black are required. Accordingly, when the large-sized cover sliding means is attached to each toner supply device of 4 colors, the dimensions of the entire apparatus are increased. In the case where the dimensions of the apparatus are substantially reduced, the cover can not be operated smoothly so that the operating property is lowered, which is a problem.

SUMMARY OF THE INVENTION

It is a primary object of the present invention to provide a compact toner supply device of simple structure having excellent operation property.

In order to solve the aforementioned problems, the present invention is to provide an image forming apparatus having an image carrier on which an electrostatic latent image is formed, a developing device that develops the electrostatic latent image and a toner supply device that supplies toner to the developing device, wherein the toner supply device comprises: a cover attached to the upper opening portion of the toner supply device which can be freely moved; a first rotational member that comes into contact with the cover; a second rotational member that rotates the first rotational member; and pivotable rotational member that rotates the second rotational member.

According to the present invention, the cover of the toner supply device is opened in the following manner: a pivotable rotational member provided with a rack is provided in the toner supply device; when the pivotable rotational member is moved, a pinion is rotated by the rack; and the cover is quickly opened by the action of a gear connected with the pinion. When the aforementioned mechanism is employed, the cover can be widely opened even if the pivotable rotational member is moved by a short distance.

DETAILED DESCRIPTION OF THE PREFERRED EMBODIMENTS

Figure 1:
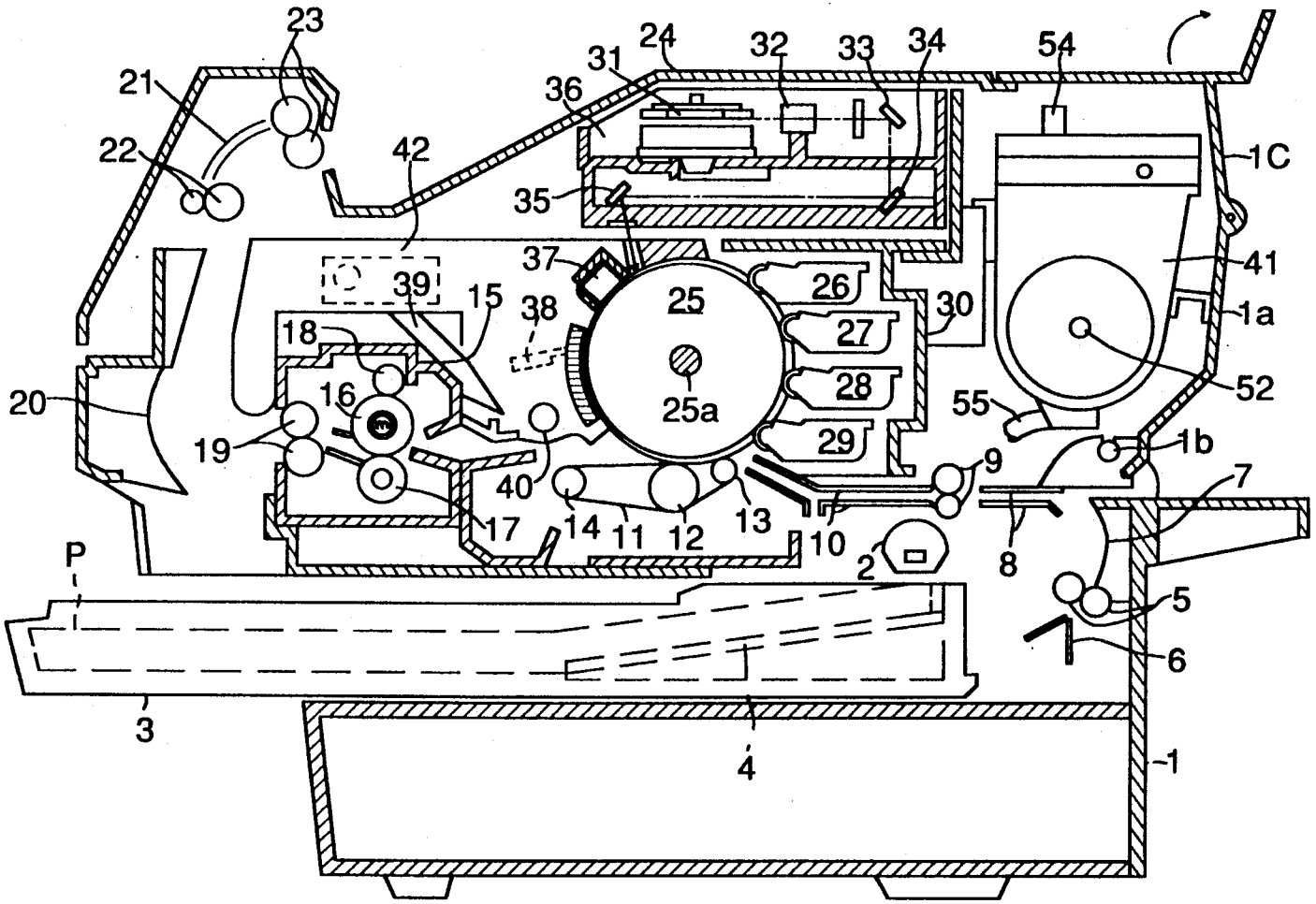
FIG. 1 is a longitudinal sectional view of an image forming apparatus to which the present invention is applied.

FIG. 1 is a view showing the structure of an example of the image forming apparatus of the present invention.

In FIG. 1, numeral 1 is a lower frame of the image forming apparatus, a semicircular sheet feed roller 2 for feeding a recording sheet P is provided in the lower frame, and a sheet feed cassette 3 for accommodating a plurality of recording sheets P is detachably provided in the lower frame 1. A push-up plate 4 is provided in the sheet feed cassette 3. The recording sheets P are fed one by one from the sheet feed cassette 3 by a separation means. Numeral 5 is a conveyance roller provided in the lower frame for conveying recording sheets P. The conveyance roller 5 is disposed between a guide plate 6 to guide the leading edge of recording sheet P and a reversal guide plate 7.

Numeral 8 is a guide plate that guides the recording sheet P to a registration roller 9 after the recording sheet P has been reversely fed. Numeral 10 is a guide plate by which the recording sheet P is guided to the direction of a transfer belt 11 after the recording sheet P has passed through the registration roller 9, and the transfer belt 11 is provided around a transfer roller 12, a roller 13, and a drive roller 14. Numeral 15 is a fixing unit by which an image, which has been transferred onto the recording sheet P, is fixed, and which is composed of a thermally fixing roller 16 and a pressure contact roller 17, and the thermally fixing roller 16 is contacted with a cleaning roller 18 with pressure, and is cleaned when it is rotated. Numeral 19 is a sheet delivery roller by which the recording sheet P is delivered from the fixing unit 15. A delivery sheet tray 24 is structured so that the recording sheet P is delivered on the delivery sheet tray 24 that is provided on almost the entire surface of the upper portion of an upper frame 1*a*, by a recording sheet guide member 20, a guide path 21 that is formed on the upper frame 1*a*, and conveyance rollers 22 and 23. A photoreceptor drum 25 for image formation is provided in an almost central portion of the upper frame 1*a*, and a developing unit frame 30 is provided in the manner that: four developing units 26, 27, 28, and 29 are located around the surface of the photoreceptor drum 25. Numeral 31 is a polygonal mirror by which laser beams irradiated from a laser beam source 32 are reflected, and the laser beams are further reflected by reflection mirrors 33, 34, and 35, and then expose the photoreceptor drum 25. Numeral 36 is an optical system frame into which an optical system composed of the polygonal mirror 31 and reflection mirrors 33, 34, and 35, is integrally provided, and which is assembled into the uppermost portion of the upper frame 1*a*.

Numeral 37 is a charging electrode by which the entire surface of the photoreceptor drum 25 is charged. The charging electrode 37 is provided in a frame 42 in a portion of the upper frame 1*a*. Numeral 38 is a cleaning blade by which residual developer, which adheres onto the surface of the photoreceptor drum 25, is scraped off after the image has been transferred onto the recording sheet P from the photoreceptor drum 25. A conveyance unit 39 by which the scraped toner is received and delivered to the outside of the cleaning unit, is provided, and a toner receiving member 40 by which the toner scraped off by the cleaning blade is effectively sent to the conveyance unit 39, is provided to the lower portion of the cleaning blade 38. Numeral 41 is a toner supply device appropriately fixed to a portion of the upper frame 1*a*. The toner supply device 41 supplies color and black toners to the developing units 26, 27 and 28. Only one toner supply device 41 is shown in the drawing, however, 4 sets of toner supply devices are actually provided in parallel. The toner supply device 41 supplies toners of cyan, magenta, yellow and black to the developing units 26, 27, 28 and 29, so that color and black development is carried out by the developing units. The lower frame 1 and the upper frame 1*a* are structured in the manner that the upper frame can be rotated around a shaft 1*b* so that the passage for recording sheet P can be opened. In the case where recording sheet P has been jammed, it does not reach the fixing unit 15. In this case, the upper frame 1*a* is opened around the shaft 1*b* so that jammed recording sheet P can be taken out. The photoreceptor drum 25 is provided in the frame 42 through the shaft 25*a*, wherein the cleaning blade 38 is attached to the frame 42. The shaft 25*a* supports the upper frame 1*a*.

Numeral 1*c* is a cover by which a portion of the upper frame 1*a* can be opened when color toner is supplied to each toner supply device 41.

Figure 2:
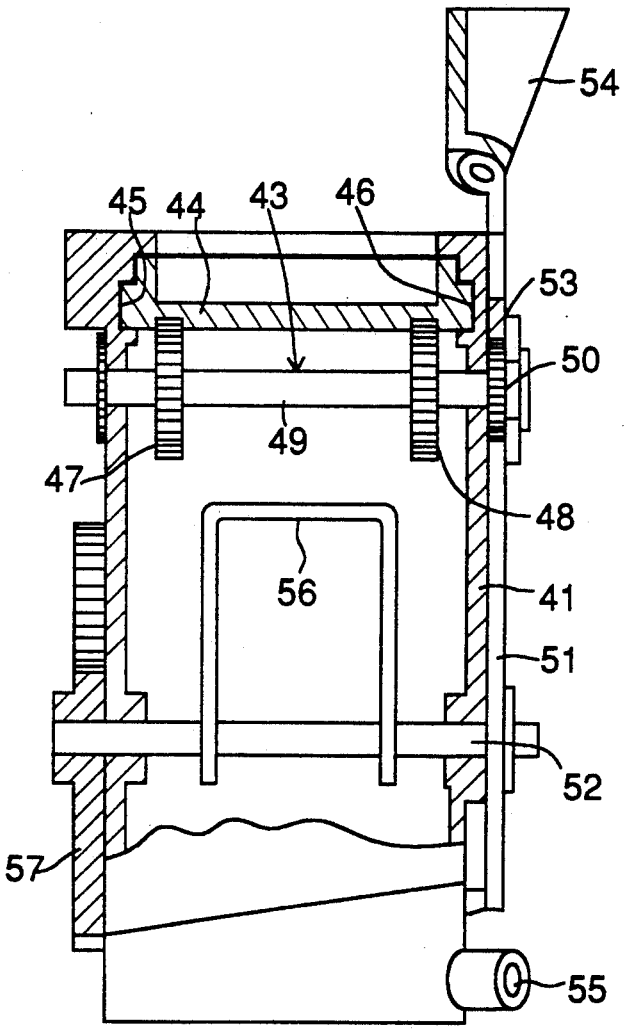
FIG. 2 is a partial cut-away side view of the toner supply device of an example.
Figure 3:
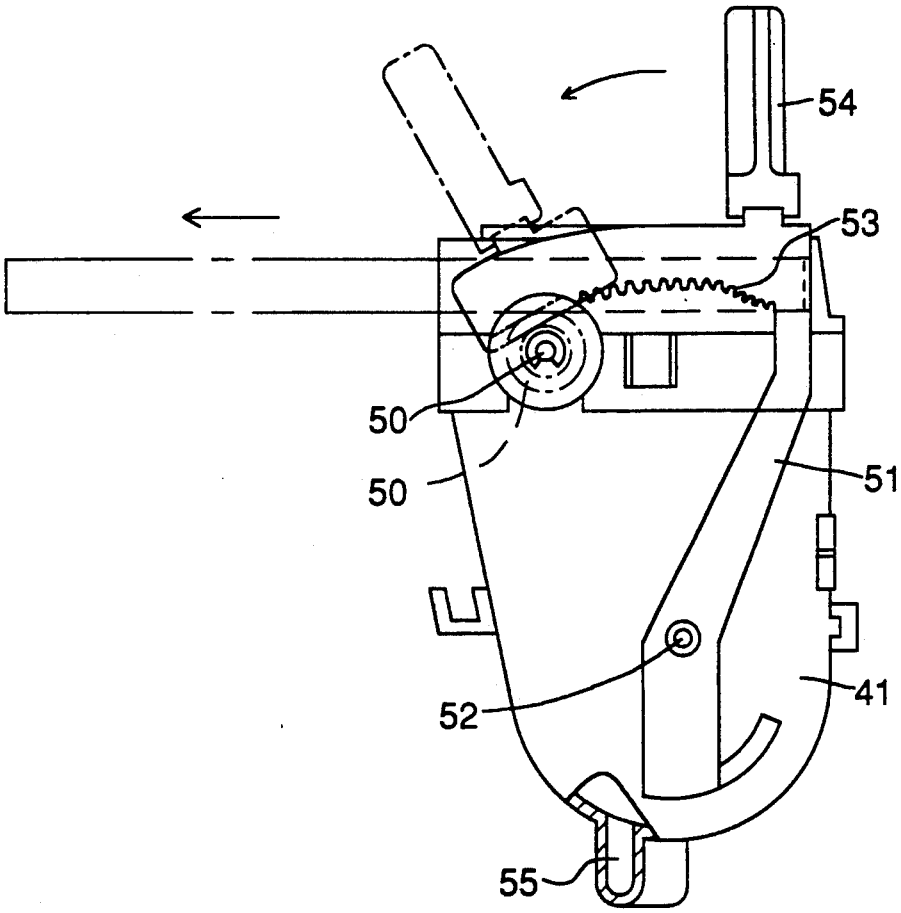
FIG. 3 is a schematic illustration showing the operation of the toner supply device of the example.

The structure of the toner supply device 41 will be explained with reference to FIG. 2. An opening 43 is formed in the upper portion of the toner supply device 41 for supplying color or black toner. A sliding cover 44 that slides along the opening is provided on the guide grooves 45 and 46. Numerals 47 and 48 are wheels for cover sliding that are disposed below the sliding cover 44 and contacted with it. The sliding wheels 47 and 48 are attached on the shaft 49 that penetrates the toner supply device 41, wherein the distance between the sliding wheels 47 and 48 is maintained to be a predetermined value. One end of the shaft 49 is projected to the outside of the toner supply device 41, and a pinion 50 is mounted on the end of the shaft 49. Numeral 51 is a lever that is disposed on the outer surface of the toner supply device 41, being rotatably supported by a shaft 52, wherein an arcuate rack 53 to rotate the pinion 50 is provided to the lever 51 as shown in FIG. 3. As shown in FIG. 3, a handle 54 is attached to the lever 51 in such a manner that the handle 54 is projected to the upper portion of the toner supply device 41. Numeral 55 is a supply port provided in the lowermost portion of the toner supply device 41 for supplying toner to the developing unit 26, 27, 28 or 29. Numeral 56 is a toner stirring member attached to the shaft 52 penetrating the toner supply device 41. The toner stirring member 56 is appropriately rotated by the driving wheel 57 mounted on the other end of the shaft 52 for the purpose of preventing the toner from being deposited on the inner wall of the toner stirring device 41 in case the deposited toner can not be supplied properly. In order to slide the sliding cover 44, the following means may be employed: the sliding wheels 47 and 48 are formed into a gear; and racks are formed on the surface of the sliding cover 44 being opposed to the sliding wheels 47 and 48. Alternatively, a frictional member such as a member made of rubber may be provided on the surfaces of the wheels 47 and 48, and the opposed surfaces may be formed to be uneven. Also, the frictional member may be provided on the surfaces, and the surfaces of the wheels 47 and 48 may be formed to be uneven. The toner supply device 41 and the sliding cover may be made of a metal, for example, an aluminum alloy by means of die casting. Alternatively the toner supply device 41 and the sliding cover may be made of resin by means of molding.

Color toner is supplied by the toner supply device 42 in the following manner. First, the cover 1*c*, which is a portion of the upper frame 1*a*, is opened in the arrowed direction shown in FIG. 1 so that the toner supply device 41 is exposed. Next, the lever 51 is pushed to the left in the arrowed direction as shown in FIG. 3, so that the lever 51 is rotated counterclockwise around the shaft 52. As a result, the pinion 50 is also rotated counterclockwise by the action of the rack 53 provided to the lever 51. Simultaneously, the wheels 47 and 48 are also rotated in the same direction through the shaft 49. Therefore, the sliding cover 44 is moved on the guide grooves 45 and 46 in the arrowed direction shown in FIG. 3, so that the opening 43 of the toner supply device 41 is opened. In this case, the gear ratio between the rack 53 and the pinion 50 is determined so that the movement amount of the sliding cover 44 can be larger than those of the handle 54 and the lever 51.

Next, a toner cartridge (not shown in the drawing) is set in the opening 43 of the toner supply device 41 so the toner is supplied to the toner supply device 41. Alternatively, toner is supplied through the opening 43 from a container. After toner has been supplied to the toner supply device 41, the cartridge is disconnected, and the handle 54 is returned in a direction opposite to the arrowed direction shown in FIG. 3. As a result, the pinion 50 is rotated clockwise by the rack 53 of the lever 51. Therefore, the sliding cover 44 is slid along the guide grooves 45 and 46 by the wheels 47 and 48 that are driven through the shaft 49. In this manner, the opening 43 is closed by the sliding cover 44. Finally, the cover 1*c*is closed, and the toner supply operation is completed. The toner provided in the toner supply device 41 is fed in accordance with the image formation of the image forming apparatus in the following manner: the drive wheel 57 is driven by the drive mechanism so that the toner stirring member 56 stirs the toner; and the toner is supplied from the supply port 55 to the developing unit 26, 27, 28 or 29.

The present invention explained above supplies the following effects.

In the apparatus of the invention, the lever 51 is provided outside the toner supply device 41, and the handle 54 is disposed in the upper portion of the toner supply device. Therefore, the handle 54 can be operated very smoothly. When 4 color toners are used, 4 toner supply devices are disposed. In this case, the lever 51 can be compactly provided to each toner supply device. Therefore, the dimensions of the apparatus can be reduced.

Compared with the moving range of the lever 51, the moving range of the sliding cover 44 can be extended. Accordingly, the moving range of the lever 51 can be reduced, and the operating property can be improved.

What is claimed is:

1. An image forming apparatus including an image carrying member on which an electrostatic latent image is formed, developing means for developing the latent image and a toner replenishment means for replenishing toner to the developing means, the image forming apparatus comprising:

(a) a movable cover provided on an upper opening portion of the toner replenishment means;

(b) a first rotational member in contact with a lower portion of the cover;

(c) a second rotational member for rotating the first rotational member; and (d) a pivotable member for rotating the second rotational member through a driving operation of the pivotable member.

2. The image forming apparatus of claim 1, wherein the second rotational member and the pivotable member comprises a pinion and a rack respectively.

3. The image forming apparatus of claim 1, wherein the first rotational member comprises a plurality of rotational members.

* * * * *